US006003759A

United States Patent [19]

Kenner et al.

[11] Patent Number: 6,003,759

[45] Date of Patent: Dec. 21, 1999

[54] FOLDING BOX

[75] Inventors: Ralf Kenner, Pleidelsheim, Germany; Wayne Loprete, Crugers, N.Y.

[73] Assignee: CD Cartondruck GmbH, Obersulm, Germany

[21] Appl. No.: 09/022,924

[22] Filed: Feb. 12, 1998

[30] Foreign Application Priority Data

May 20, 1997 [EP] European Pat. Off. ..... 97108117

[51] Int. Cl.[6] ..... B65D 5/00

[52] U.S. Cl. ..... 229/104; 229/117.05; 229/182.1; 229/132

[58] Field of Search ..... 229/182.1, 104, 229/107, 117.01, 132, 117.05, 117.06

[56] References Cited

U.S. PATENT DOCUMENTS

| | | | |
|---|---|---|---|
| 1,956,159 | 4/1934 | Reilly et al. | 229/132 X |
| 2,286,647 | 6/1942 | Roberts | 229/182.1 |
| 2,326,648 | 8/1943 | Horr | 229/117.01 |
| 2,575,654 | 11/1951 | Casler | 229/182.1 |
| 2,738,871 | 3/1956 | Lugt, Jr. | 229/117.01 |
| 4,109,848 | 8/1978 | Kipp et al. | 229/117.01 X |

FOREIGN PATENT DOCUMENTS 0 545 723 6/1993 European Pat. Off. .

2 698 080 5/1994 France .

*Primary Examiner*—Stephen P. Garbe
*Assistant Examiner*—Tri M. Mai
*Attorney, Agent, or Firm*—Darby & Darby

[57] ABSTRACT

A folding box (10) for storing and for transporting goods, in particular cosmetics, having a pack casing with an outer front-wall element (12), a rear-wall element (14), an inner front-wall element (16), a side-wall element (18), which is provided in each case between the outer front-wall element (12) and the rear-wall element (14) and between the rear-wall element (14) and the inner front-wall element (16) and is connected to the adjoining elements via border folding lines (24), a lid unit (28), which is connected via a folding line (22), and a base unit (30), which is connected via a folding line (20), is characterized in that provided in the region between the border folding lines (24) of one side-wall element (18) and/or of both side-wall elements (18) are at least a plurality of contour folding lines (26) running parallel to the border folding lines (24), with the result that the cross-sectional contour of the side-wall element (18) corresponds to a cross-sectional contour which is curved convexly outwards, the base unit (30) being designed as an automatic base.

13 Claims, 4 Drawing Sheets

FOLDING BOX

TECHNICAL FIELD

The present invention relates to a folding box for storing and for transporting goods, in particular cosmetics, having a pack casing with an outer front-wall element, a rear-wall element, an inner front-wall element, a side-wall element, which is provided in each case between the outer front-wall element and the rear-wall element and between the rear-wall element and the inner front-wall element and is connected to the adjoining elements via border folding lines, a lid unit, which is connected via a folding line, and a base unit, which is connected via a folding line.

PRIOR ART

A large number of folding packs of the type mentioned in the introduction, which come in a wide variety of forms, are known. In particular in the area of high-quality cosmetics, folding boxes of this type serve for retailing the packaged products, in particular, in an aesthetically pleasing manner. Furthermore, reliable storage of the goods during transportation and as they are displayed is to be ensured.

DESCRIPTION OF THE INVENTION

The object, or the technical problem, of the invention is to design a folding box of the type mentioned in the introduction such that an aesthetically pleasing form can be realized, straight forward production is possible, high stability can be ensured and, in particular, the pack casing can be erected without complex assembly work.

The folding box according to the invention is provided by the features of the independent claim, claim 1. Advantageous configurations and developments form the subject matter of the dependent claims.

Accordingly, the folding box according to the invention is distinguished in that provided in the region between the border folding lines of one side-wall element and/or of both side-wall elements are at least a plurality of contour folding lines running parallel to the border folding lines, with the result that the cross-sectional contour of the side-wall element corresponds to a cross-sectional contour which is curved convexly outwards, the base unit has a first base flap, which is integrally formed on the inner front-wall element, and a second base flap, which is integrally formed on the rear-wall element, and the first base flap has a folding line, with the result that the base flap has an inner flap region and an outer flap region, the inner flap region being folded inwards and the outer flap region being folded outwards through 360° (degrees) and the outer flap region being connected to the second base flap or, conversely, the second base flap having a folding line providing for corresponding folding and being connected to the first base flap.

It is thus possible to realize a folding box which has a curved outer contour in some areas and can be supplied to the filling company in a state in which it is pre-folded flatly, it being possible for the filling company, without complex assembly work, to erect the pack casing and then introduce the goods and close the lid unit.

A particularly preferred configuration which has particularly high dimensional stability is distinguished in that, laterally in each case, the base unit with its base flaps has a convex outer contour which corresponds essentially to the convex folding of the side-wall elements.

As regards the dimensional stability of the folding box, it has, furthermore, turned out to be favourable to design the folding box such that the lid unit has a first lid flap, which is integrally formed on the rear-wall element, and a second lid flap, which is integrally formed on the outer front-wall element, a further configuration being distinguished in that, laterally, the lid unit with its lid flaps has a convex outer contour essentially corresponding to the convex folding of the side-wall elements.

A particularly aesthetically pleasing folding box with a base which is offset inwards can be realized according to the invention in that the base flaps are respectively connected to the inner front-wall element and the rear-wall element, in each case via an intermediate flap which is folded inwards via the folding line and has another folding line. In a preferred configuration, intermediate flaps of this type are also used in the region of the lid flaps.

In order to ensure that the pre-folded flat folding box has a favourable symmetrical folded shape, it is particularly advantageous for there to be an odd number of contour folding lines in each side-wall element, a preferred configuration having three, five or seven contour folding lines provided for each side-wall element.

A further advantageous embodiment which ensures particularly high stability when the pack casing has been erected is distinguished in that integrally formed on the outside of the first base flap, via a folding line, is an insertion flap which, when the box has been erected, engages in a clearance which is provided on the inner front wall and has essentially the same contour as the insertion flap. A further feature of the invention likewise provides for the stability to be increased, particularly advantageously, in that integrally formed on the outside of the second base flap is a protrusion unit which, when the folding box has been erected, engages in a slit-like clearance which is provided in the folding line of the insertion flap.

In order for the automatic folding movement of the base unit to be affected favourably when the pack casing is being erected, it has turned out to be advantageous to design the folding box such that the inwardly folded intermediate flaps are adhesively bonded respectively on the inner front-wall element and on the rear-wall element.

Further embodiments and advantages of the invention are given by the features further outlined in the claims and by the exemplary embodiments indicated hereinbelow. The features of the claims may be combined with one another as desired, as long as they are not obviously mutually exclusive.

BRIEF DESCRIPTION OF THE DRAWING

The invention and advantageous embodiments and developments of the same are explained and described in more detail hereinbelow with reference to the examples illustrated in the drawing. According to the invention, the features which can be gathered from the description and the drawing can be used on their own or in any combination. In the drawing.

METHOD OF IMPLEMENTING THE INVENTION

Figure 1:
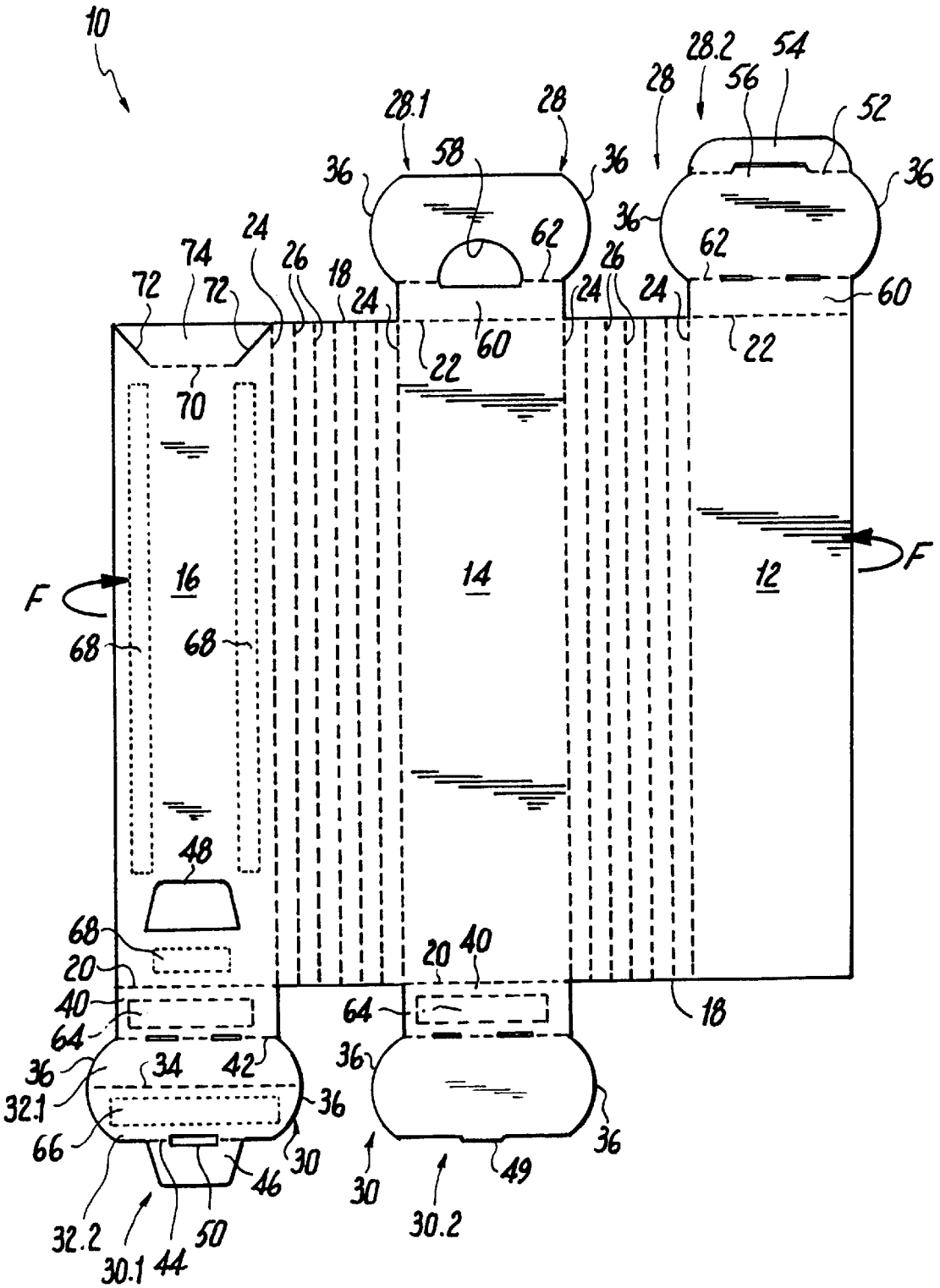
FIG. 1 shows a schematic illustration of the blank of a folding box with contour folding lines in the side-wall region and provision for automatic base folding.

A folding box 10 has an outer front-wall element 12, designed as an elongate rectangle, a rear-wall element 14 and an inner front-wall element 16 of the same rectangular shape. A side-wall element 18 is connected, via border folding lines 24, between the outer front-wall element 12 and the rear-wall element 14. In the same way, the side-wall element 18 is connected, via border folding lines 24, between the rear-wall element 14 and the inner front-wall element 16. A total of five regularly spaced-apart contour folding lines 26 in each case are provided in the region of the side-wall elements 18, parallel to the border folding lines 24, and make it possible for the side-wall elements 18 to be folded into an essentially convex outer contour of polygonal form.

Integrally formed on the underside of the inner front-wall element 16, via a folding line 20, is a rectangular intermediate flap 40 which, in turn, has a first base flap 30.1 integrally formed on it via a folding line 42. The side borders of the first base flap 30.1 have a convex outer contour 36, such that the projected development of the outer contour 36 corresponds essentially to the width of the side-wall elements 18.

Provided approximately in the centre of the first base flap 30.1, parallel to the bottom border, is a folding line 34 which subdivides the base flap 30.1 into an inner flap region 32.1 and an outer flap region 32.2.

Furthermore, an insertion flap 46 is integrally formed on the outside of the first base flap 30.1, via a folding line 44, a slit-like clearance 50 being provided in the folding line 44. Finally, there is also a clearance 48 in the bottom region of the inner front-wall element 16, the contour of said clearance essentially corresponding to the outer contour of the insertion flap 46.

The first base flap 30.1 forms part of a double-walled base unit 30, this base unit 30 having a further, second base flap 30.2, which is connected to the bottom border of the rear-wall element 14 via the same type of intermediate flap 40, which is configured similarly with the folding lines 20 and 42. The second base flap 30.2 has the same convex outer contour 36 as the first base flap 30.1.

At its bottom border, the base flap 30.2 has a tongue-like protrusion unit 49, the width of which corresponds essentially to the width of the clearance 50 in the folding line 44.

Integrally formed on the top border of the rear-wall element 14, via an intermediate flap 60 with folding lines 22 and 62, is a first lid flap 28.1, which likewise has the same convex outer contour 36 as the base flaps 30.1, 30.2. The first lid flap 28.1 constitutes part of a lid unit 28, which has a second lid flap 28.2 which is integrally formed on the top side of the outer front-wall element 12, via an intermediate flap 60 with the folding lines 22 and 62. The further folding flap 54 is integrally formed on the top, outer border of the lid flap 28.2, via a folding line 52. A tongue-like protrusion unit 56 with a relatively small protrusion width is punched out of the folding flap 54, in the region of the folding line 52.

The first lid flap 28.1 has a semicircular clearance 58, the base of the semicircle being arranged essentially in the region of the folding line 62 of the first lid flap 28.1, and the size of the base corresponding essentially to the width of the protrusion unit 56.

The blank is illustrated in FIG. 1 such that those sides of the outer front-wall element 12 and of the outer wall element 14 which are directed towards the viewer also form the outside of the folding box 10 when the latter has been folded. The blank is then folded into a flat pre-folded form, which is supplied to the customer in the pre-folded form according to FIG. 2, in which case the customer then erects the box and fills and closes it.

The folding operation proceeds as follows. First of all, the first base flap 30.1 and the second base flap 30.2 are folded over inwards along the folding lines 20, i.e. are folded over rearwards away from the viewer in FIG. 1, and the intermediate flaps 40 are adhesively bonded respectively to the corresponding wall regions of the inner front-wall element 16 and of the rear-wall element 14. In FIG. 1, the adhesive region 64 is illustrated on the intermediate flaps as a chain-dotted rectangle.

Moreover, a further adhesive region 66 is provided in the outer flap region 32.2 of the first base flap 30.1, said further adhesive region being directed towards the viewer in FIG. 1. Finally, the inner front-wall element 16 also has adhesive surfaces 68, which are likewise directed towards the viewer in FIG. 1. As the folding operation continues, the inner front-wall element 16 and the outer front-wall element 12 are then folded over (folding direction F according to FIG. 1) around the central contour folding line 26 of the respective side-wall element, the outer front-wall element 12 being adhesively bonded to the inner front-wall element 16 via the adhesive surfaces 68.

Figure 2:
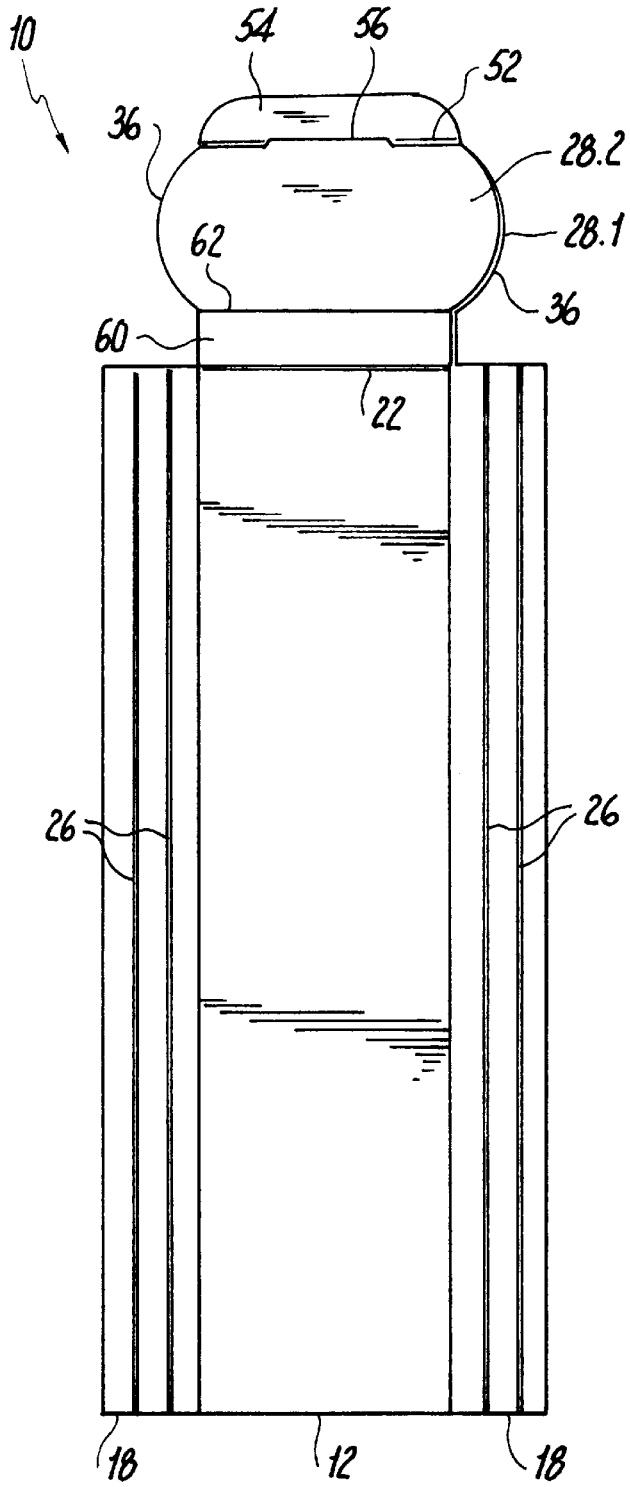
FIG. 2 shows a schematic illustration of the folding box according to FIG. 1 in the pre-folded, flat transportation state.
Figures 3, 4, 5:
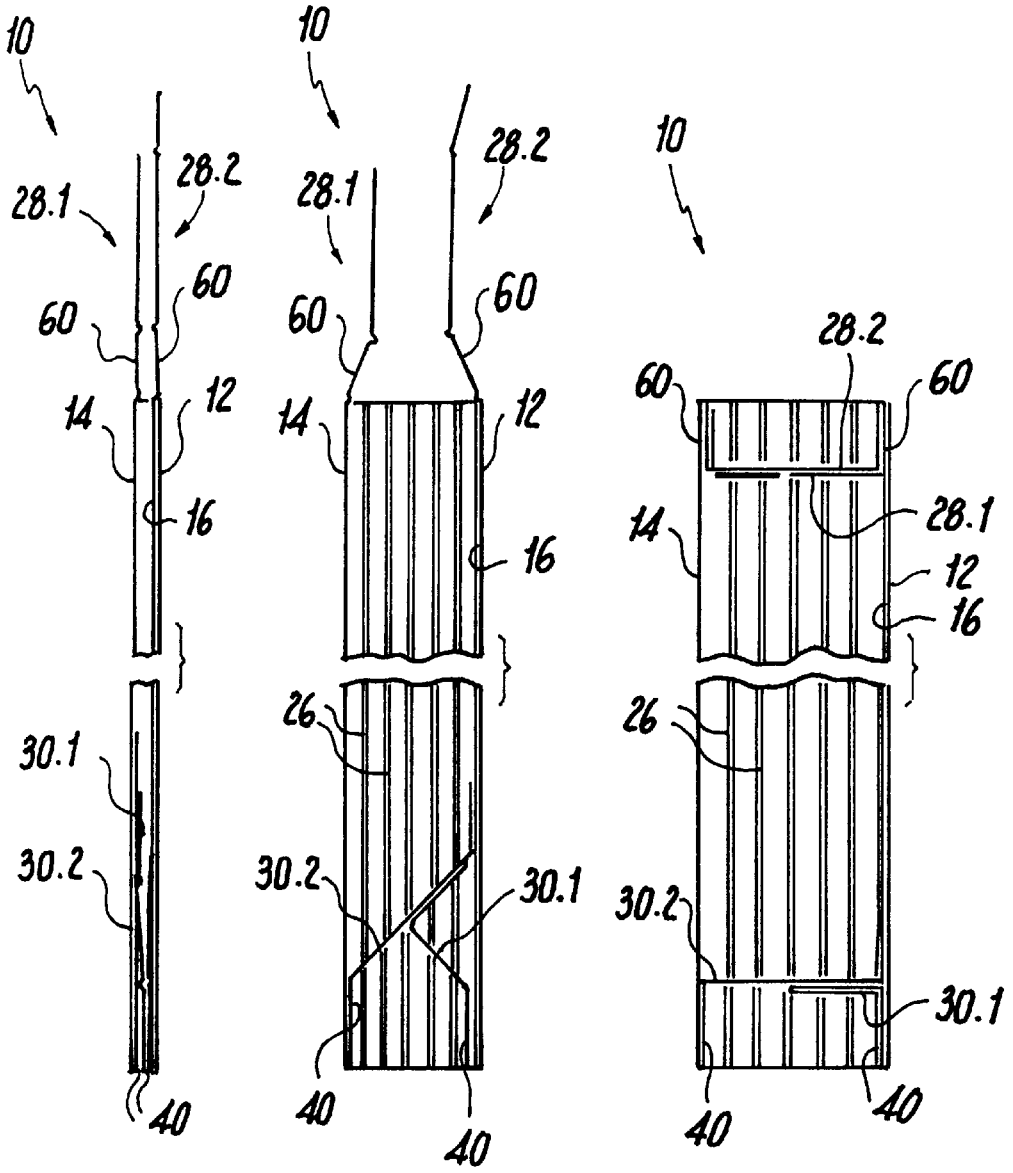
FIGS. 3, 4, 5 show schematic sectional illustrations through the folding box according to FIG. 1 which proceeds from the pre-folded, flat form according to FIG. 3, by way of an intermediate stage according to FIG. 4, to the fully folded form according to FIG. 5.
Figure 6:
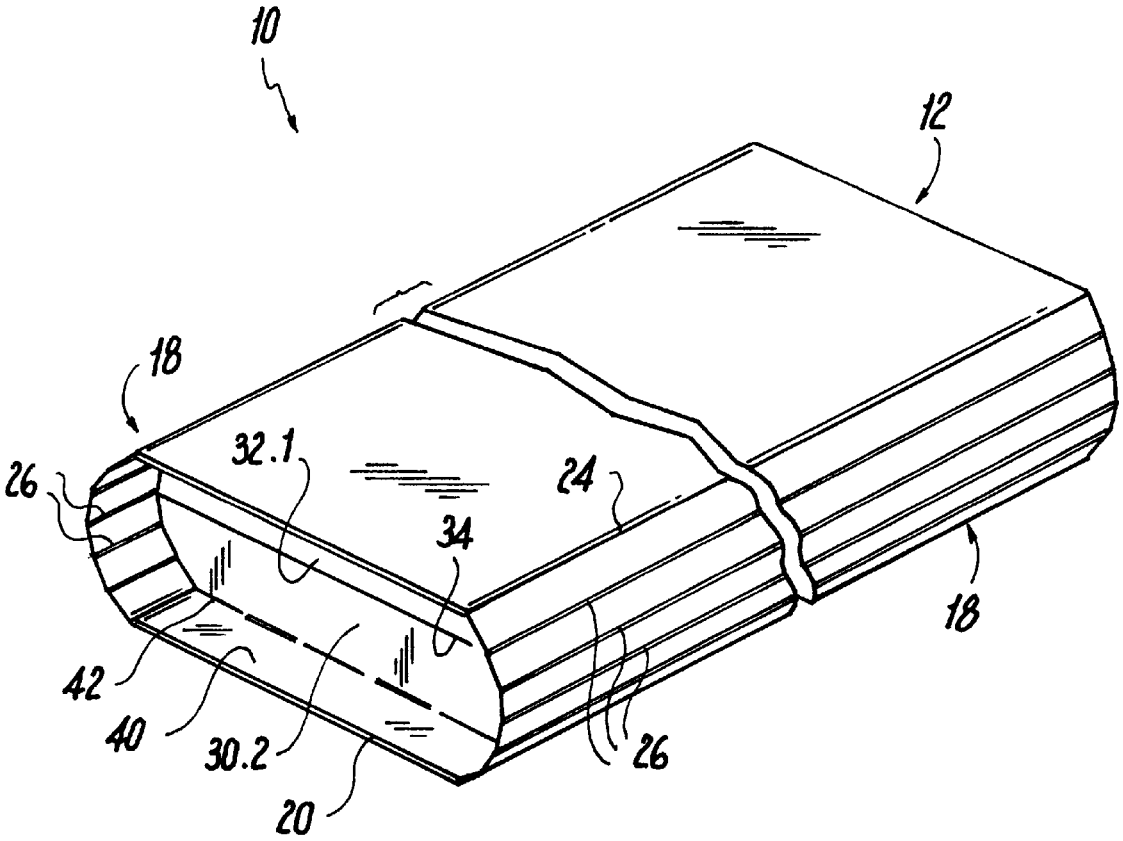
FIG. 6 shows a schematic perspective illustration of the folding box according to FIG. 1 in the folded state.

Completion of this folding operation provides the pre-folded flat folding box according to FIG. 2. It is in this state that the folding box is despatched to the filling company. In order to erect the pack casing, all that is required is for pressure to be exerted on the outer contour folding line 26 from both sides, as a result of which the base of the folding box 10 folds automatically and the folding box 10 as a whole assumes its three-dimensional form. The sequence of movements of the individual folding-box elements during the folding operation is illustrated schematically in FIGS. 3 to 5. In the erected state according to FIG. 5, the insertion flap 46 of the first base flap 30.1 engages with the clearance 48 of the inner front-wall element 16. Furthermore, the protrusion unit 49 of the second base flap 30.2 engages in the slit-like clearance 50 of the folding line 44. This ensures a stable base structure.

After the folding box 10 has been filled, which is not illustrated in the Figures, the first lid flap 28.1 is folded over inwards, via its intermediate flap 60, along the folding lines 22 and 62, the intermediate flap 60 being provided parallel to the rear-wall element 14. Thereafter, the second lid flap 28.2 is likewise folded inwards, via the intermediate flap 60 with the folding lines 22 and 62, it being the case here too, that the intermediate flap 60 is provided parallel to the front-wall element 12. At the same time, the folding flap 54 is folded upwards to rest parallel against the inside of the rear-wall element 14. In this case, the protrusion unit 56 engages in the base of the semicircular clearance 58.

Finally, there is also a folding line 70 in part of the top border region of the inner front-wall element 16, parallel to the top border, and sloping slits 72 run from each end of said folding line to the corner region, this forming a folding element 74 which makes an additional contribution to securing the lid flaps in position when in the closed state.

We claim:

1. Folding box for storing and for transporting goods, in particular cosmetics, comprising:

a pack casing having an outer front-wall element, a rear-wall element, an inner front-wall element, side-wall elements provided between the outer front-wall element and the rear-wall element and between the rear-wall element and the inner front-wall element and connected thereto via border folding lines, a lid unit connected to the pack casing via a lid folding line, and a base unit connected to the pack casing via a base folding line, wherein at least one side-wall element has a plurality of contour folding lines running parallel to the border folding lines such that the at least one side-wall element has a cross-sectional contour that is generally curved convexly outwards, the base unit has a first base flap that is integrally formed on one of the inner front-wall element and the rear-wall element, and a second base flap that is integrally formed on the other of the inner front-wall element and the rear-wall element, and the first base flap has a base flap folding line such that the first base flap has an inner flap region and an outer flap region, the inner flap region being folded inwards and the outer flap region being folded into an overlying relationship with said fist inner flap region when the container is erected and the outer flap region being connected to the second base flap.

2. Folding box according to claim 1, wherein the base unit with its base flaps has a lateral convex outer contour that corresponds essentially to the contour of the at least one sidewall element.

3. Folding box according to claim 1, wherein the lid unit has a first lid flap that is integrally formed on the rear-wall element, and a second lid flap that is integrally formed on the outer front-wall element.

4. Folding box according to claim 3, wherein the lid unit with its lid flaps has a lateral convex outer contour essentially corresponding to the contour of the at least one side-wall element.

5. Folding box according to claim 3, wherein the first and second lid flaps are respectively connected to the rear-wall element and the outer front-wall element via a lid intermediate flap that has a lid intermediate flap folding line and is folded inwards via the lid folding line.

6. Folding box according to claim 1, wherein the first and second base flaps are respectively connected to the inner front-wall element and the rear-wall element via a base intermediate flap that has a base intermediate flap folding line and is folded inwards via the base folding line.

7. Folding box according to claim 6, wherein the inwardly folded base intermediate flaps are adhesively bonded respectively on the inner front-wall element and on the rear-wall element.

8. Folding box according to claim 1, wherein, integrally formed on the outside of the first base flap, via an insertion flap folding line, is an insertion flap that, when the folding box has been erected, engages in a clearance that is provided on the inner front wall and has essentially the same contour as the insertion flap.

9. Folding box according to claim 8, wherein, integrally formed on the outside of the second base flap is a protrusion unit that, when the folding box has been erected, engages in a slit-like clearance that is provided in the insertion flap folding line of the insertion flap.

10. Folding box according to claim 1, wherein the outer wall of the inner front-wall element is adhesively bonded to the inner wall of the outer front-wall element.

11. Folding box according to claim 1, wherein the plurality of contour folding lines comprises an odd number of contour folding lines.

12. Folding box of claim 11, wherein the plurality of contour folding lines comprises an odd number of contour folding lines selected from the group consisting of three, five, and seven.

13. Folding box of claim 12, wherein the plurality of contour folding lines comprises five contour folding lines.

* * * * *